US007038624B2

(12) United States Patent
Yegin et al.

(10) Patent No.: US 7,038,624 B2
(45) Date of Patent: May 2, 2006

(54) PATCH ANTENNA WITH PARASITICALLY ENHANCED PERIMETER

(75) Inventors: Korkut Yegin, Grand Blanc, MI (US); Daniel G. Morris, Ovid, MI (US); Elias H. Ghafari, Rochester Hills, MI (US); Randall J. Snoeyink, Clarkson, MI (US); William R. Livengood, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 2 days.

(21) Appl. No.: 10/869,635

(22) Filed: Jun. 16, 2004

(65) Prior Publication Data

US 2005/0280592 A1 Dec. 22, 2005

(51) Int. Cl.
*H01Q 1/38* (2006.01)
*H01Q 1/24* (2006.01)
*H01Q 13/10* (2006.01)

(52) U.S. Cl. ..... 343/700 MS; 343/767

(58) Field of Classification Search ..... 343/700 MS, 343/815–819, 833, 834, 767, 837; 342/368
See application file for complete search history.

(56) References Cited

U.S. PATENT DOCUMENTS 4,017,864 A * 4/1977 Proctor ..... 343/767
4,590,478 A * 5/1986 Powers et al. ..... 343/700 MS
5,497,164 A * 3/1996 Croq ..... 343/700 MS
5,565,875 A * 10/1996 Buralli et al. ..... 343/700 MS
5,576,718 A * 11/1996 Buralli et al. ..... 343/700 MS
6,061,025 A * 5/2000 Jackson et al. ..... 343/700 MS
6,127,987 A * 10/2000 Maruyama et al. ..... 343/835
6,133,882 A * 10/2000 LaFleur et al. ..... 343/700 MS
6,181,279 B1 * 1/2001 Van Hoozen ..... 343/700 MS
6,184,828 B1 * 2/2001 Shoki ..... 342/372
6,421,012 B1 * 7/2002 Heckaman ..... 343/700 MS
2003/0184480 A1 * 10/2003 Shibata ..... 343/700 MS
2004/0239567 A1 * 12/2004 Van Der Poel ..... 343/700 MS
2005/0017912 A1 * 1/2005 Azoulay et al. ..... 343/725
2005/0116867 A1 * 6/2005 Park et al. ..... 343/725

FOREIGN PATENT DOCUMENTS

EP 0489934 A 6/1992
WO 03092115 A 6/2003

OTHER PUBLICATIONS

EP 05 07 6333 European Search Report dated Aug. 4, 2005.

* cited by examiner

*Primary Examiner*—Shih-Chao Chen
*Assistant Examiner*—Leith A. Al-Nazer
(74) *Attorney, Agent, or Firm*—Stefan V. Chmielewski

(57) ABSTRACT

An antenna unit is disclosed. The antenna unit includes a patch antenna element with a dielectric substrate positioned on a circuit board. A parasitically enhanced perimeter extends from the circuit board and encompasses the patch antenna to utilize surface waves in order to enhance low-elevation terrestrial antenna performance.

11 Claims, 6 Drawing Sheets

PATCH ANTENNA WITH PARASITICALLY ENHANCED PERIMETER

TECHNICAL FIELD

The present invention generally relates to patch antennas and, more particularly, to patch antennas including a parasitically enhanced perimeter for improved radiation characteristics.

BACKGROUND OF THE INVENTION

It is known in the art that automotive vehicles are commonly equipped with audio radios that receive and process signals relating to amplitude modulation/frequency modulation (AM/FM) antennas, satellite digital audio radio systems (SDARS) antennas, global positioning system (GPS) antennas, digital audio broadcast (DAB) antennas, dual-band personal communication systems digital/analog mobile phone service (PCS/AMPS) antennas, Remote Keyless Entry (RKE) antennas, Tire Pressure Monitoring System antennas, and other wireless systems.

Currently, it is known that patch antennas are employed for reception and transmission of GPS [i.e. right-hand-circular-polarization (RHCP) waves] and SDARS [i.e. left-hand-circular-polarization (LHCP) waves]. Patch antennas may be considered to be a 'single element' antenna that incorporates performance characteristics of 'dual element' antennas that essentially receives terrestrial and satellite signals. SDARS, for example, offer digital radio service covering a large geographic area, such as North America. Satellite-based digital audio radio services generally employ either geo-stationary orbit satellites or highly elliptical orbit satellites that receive uplinked programming, which, in turn, is re-broadcasted directly to digital radios in vehicles on the ground that subscribe to the service. SDARS also use terrestrial repeater networks via ground-based towers using different modulation and transmission techniques in urban areas to supplement the availability of satellite broadcasting service by terrestrially broadcasting the same information. The reception of signals from ground-based broadcast stations is termed as terrestrial coverage. Hence, an SDARS antenna is required to have satellite and terrestrial coverage with reception quality determined by the service providers, and each vehicle subscribing to the digital service generally includes a digital radio having a receiver and one or more antennas for receiving the digital broadcast. GPS antennas, on the other hand, have a broad hemispherical coverage with a maximum antenna gain at the zenith (i.e. hemispherical coverage includes signals from 0° elevation at the earth's surface to signals from 90° elevation up at the sky). Emergency systems that utilize GPS, such as OnStar™, tend to have more stringent antenna specifications as they also incorporate cellular phone communication antennas. Unlike GPS antennas which track multiple satellites at a given time, SDARS patch antennas are operated at higher frequency bands and presently track only two satellites at a time. Thus, the mounting location for SDARS patch antennas makes antenna reception a sensitive issue with respect to the position of the antenna on the vehicle. As a result, SDARS patch antennas are typically mounted exterior to the vehicle, usually on the roof. Because the patch antennas are planar and relatively small, manufactures and consumers tend to prefer the implementation of patch antennas.

Thus, patch antennas include inherent performance issues relating to terrestrial reception. Accordingly, it is therefore desirable to provide an apparatus that improves patch antenna gains at low elevation angles to improve the terrestrial reception.

SUMMARY OF THE INVENTION

The present invention relates to an antenna unit. Accordingly, one embodiment of the invention is directed to a patch antenna element and dielectric substrate positioned on a circuit board. A parasitically enhanced perimeter extends from the circuit board and encompasses the patch antenna to utilize surface waves in order to enhance low-elevation terrestrial antenna performance.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1A:
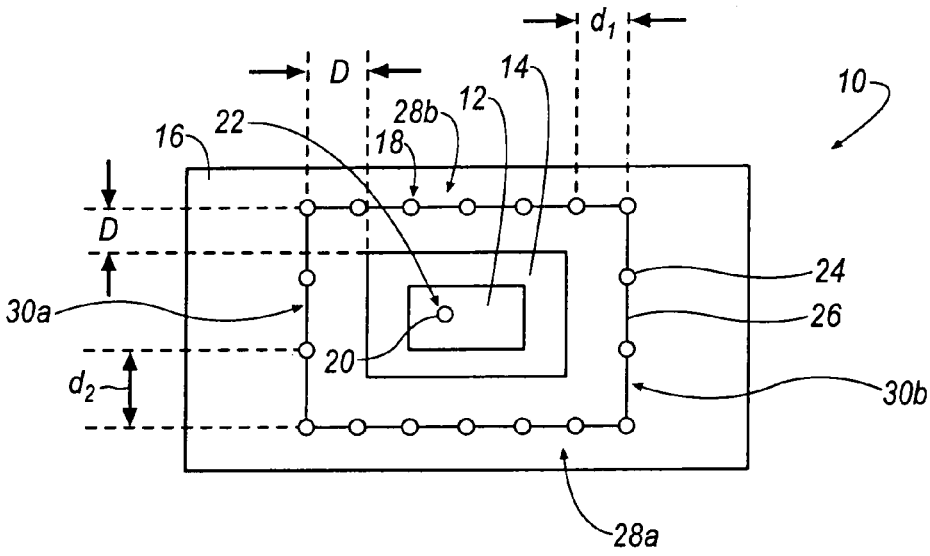
FIG. 1A illustrates a top view of a patch antenna with a parasitically enhanced perimeter according to one embodiment of the invention.
Figure 1B:
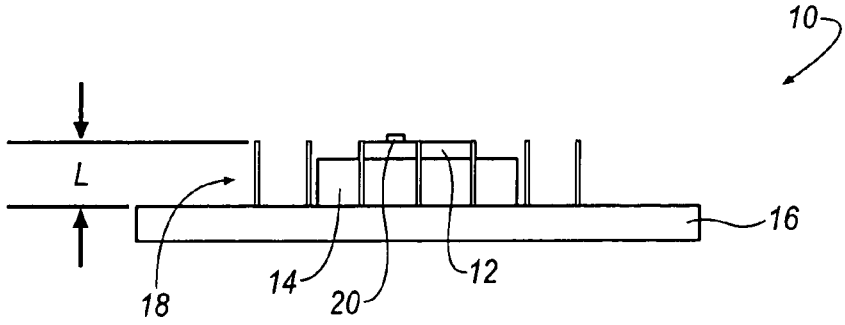
FIG. 1B illustrates a side view of patch antenna with the parasitically enhanced perimeter according to FIG. 1A.

The above described disadvantages are overcome and a number of advantages are realized by the inventive antenna unit, which is generally illustrated at 10 in FIGS. 1A and 1B. The antenna unit 10 generally includes a metal patch antenna element 12 and dielectric substrate 14 positioned on a circuit board 16. A parasitically enhanced perimeter, which is seen generally at 18, extends from the circuit board 16 and encompasses the patch antenna 12. The parasitically enhanced perimeter 18 is hereinafter referred to as a parasitic fence 18.

The antenna unit 10 is manufactured by extending a pin 20 through a feed point 22 in the patch antenna 12 and circuit board 16, which is subsequently soldered to circuitry (not shown) beneath the circuit board 16. The parasitic fence 18 generally comprises a plurality of parasitic antenna elements 24. As illustrated, the parasitic fence 18 is positioned around the patch antenna 12 and dielectric substrate 14, and, to retain and provide strength for the parasitic fence 18, the parasitic antenna elements 24 are soldered orthogonally to a metallic perimeter 26 that is also soldered and grounded to the circuit board 16. The parasitic antenna elements 24 and metallic perimeter 26 is passive such that the parasitic antenna elements 24 and metallic perimeter 26 are electromagnetically coupled to the patch antenna 12 and do not require any electronic hardware or feed from active circuitry.

According to the illustrated embodiment of the invention, the plurality of parasitic antenna elements 24 comprising the parasitic fence 18 are straight wire segments including a diameter. Hereinafter, the parasitic antenna elements 24 are referred to as wire segments 24. As seen more clearly in FIG. 1A, approximately eighteen wire segments 24 are positioned about the patch antenna 12 in a rectangular pattern; however, it is contemplated that the invention is not limited to the use of eighteen wire segments 24 nor a rectangular pattern and that any desirable amount of wire segments 24 or pattern may be implemented.

Three parameters control the radiation characteristics of the antenna unit 10. The parameters include wire diameter, the number of wires, and wire-to-patch distance. Referring to FIG. 1A, a front row 28*a* opposes a back row 28*b* of wire segments 24 and a left row 30*a* opposes a right row 30*b* of wire segments 24 in a symmetrically-disposed pattern and spaced by distances d1, d2, respectively. As also seen in the FIG. 1A, the metallic perimeter 26 is spaced from the dielectric substrate 14 by a distance, D; however, it is also contemplated that the wire segments 24 and metallic perimeter 26 is not limited to any type of symmetric spacing and may alternatively comprise any desirable, uniform or non-symmetrical perimeter, pattern, or placement that results in any desirable distance d1, d2, D. As seen in FIG. 1B, wire segments 24 have a height L.

Figure 2:
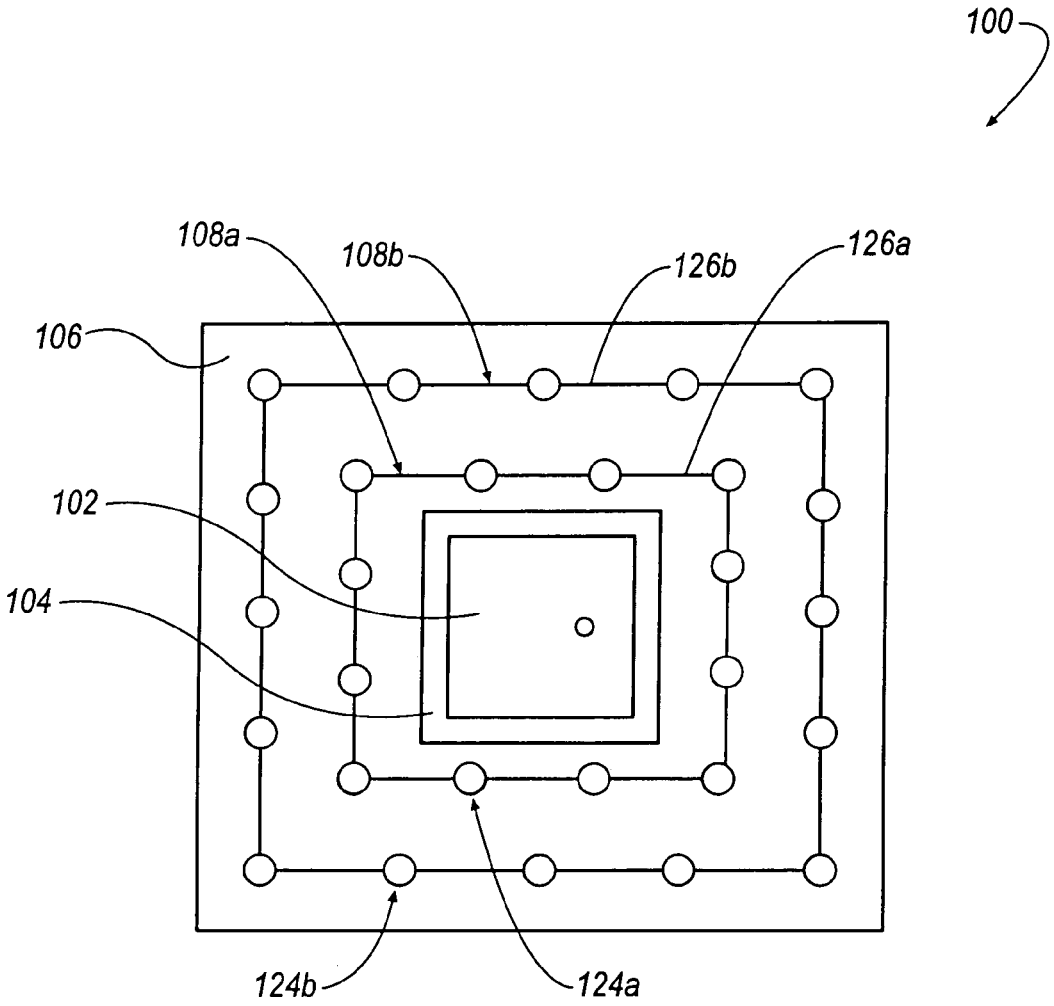
FIG. 2 illustrates a top view of a patch antenna with a parasitically enhanced perimeter according to another embodiment of the invention.
Figure 3A:
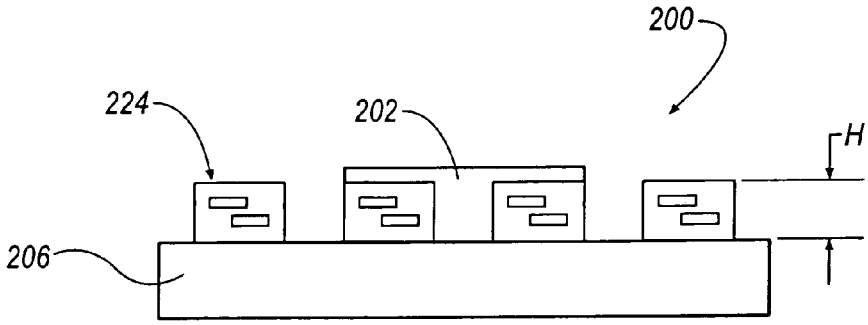
FIG. 3A illustrates a side view of a patch antenna with a parasitically enhanced perimeter according to another embodiment of the invention.
Figure 3B:
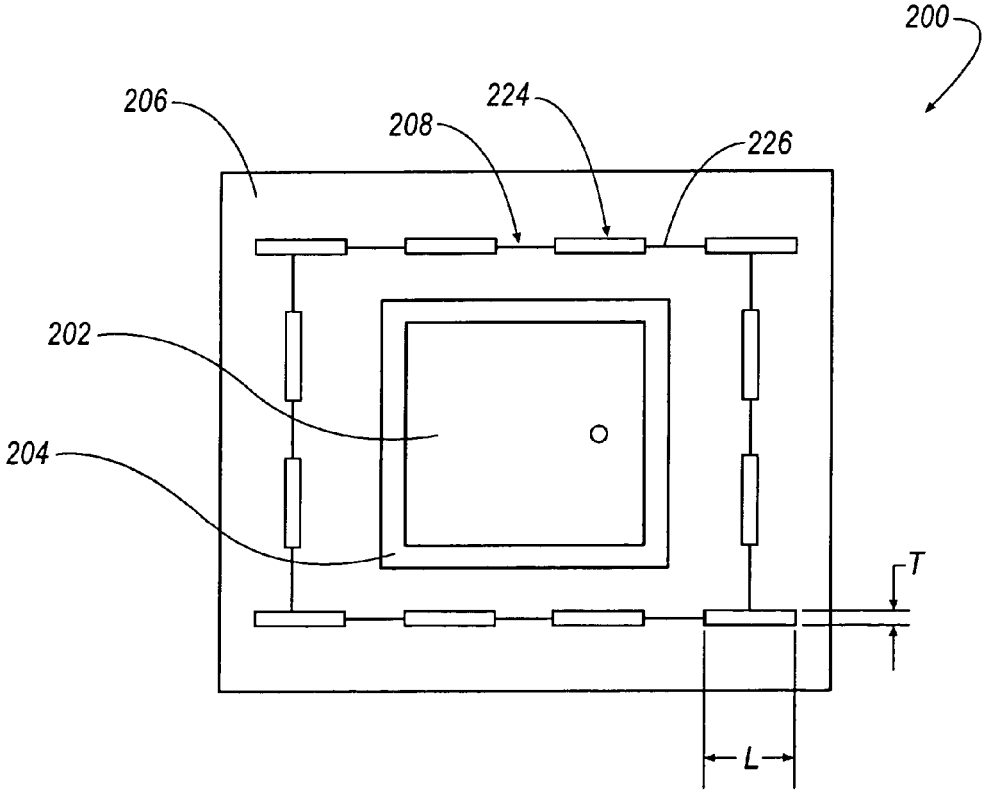
FIG. 3B illustrates a top view of patch antenna with the parasitically enhanced perimeter according to FIG. 3A.

Referring now to FIG. 2, another embodiment of the antenna unit is generally seen at FIG. 100 that functions in a similar manner as described above to control the excitation/reception of surface waves. According to the embodiment, the antenna unit 100 includes a first, inner parasitic fence 108*a* with a first inner metallic perimeter 126*a* positioned on a circuit board 106 and located about a patch antenna element 102 with a dielectric substrate 104 and a second, outer parasitic fence 108b with a second outer metallic perimeter 126*b* also positioned on circuit board 106 and disposed about the outer periphery of the first, inner parasitic fence 108*a* and metallic perimeter 126*a*. As illustrated, each wire element 124*a*, 124*b* may be off-set in a staggered relationship, or, alternatively, each wire element 124*a*, 124*b* may be aligned with respect to each wire element 124*a*, 124*b*.

Figure 4A:
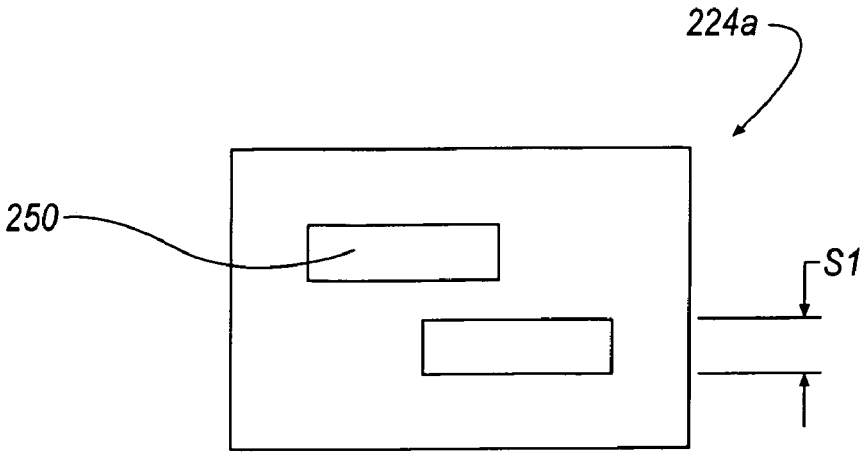
FIGS. 4A and 4B illustrates side views of parasitic elements.
Figure 4B:
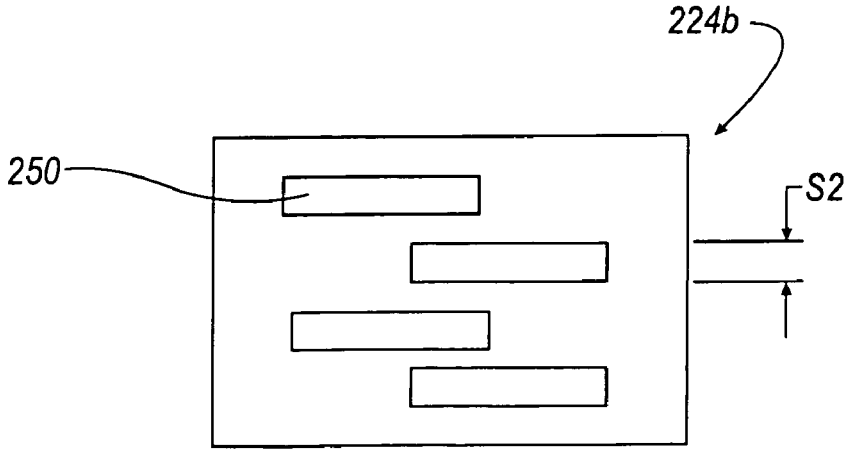

Although the illustrated embodiment of the invention in FIGS. 1A–2 discusses the use of wire segments 24, 124*a*, 124*b*, the parasitic antenna elements 24, 124*a*, 124*b* may comprise any other desirable form. Referring to FIGS. 3A–4B, another embodiment of the antenna unit is seen generally at 200 and includes a perimeter 208 of thin metallic plates 224 including a metallic perimeter 226 positioned on a circuit board 206 and surrounding a patch antenna element 202 with a substrate 204. Each plate 224 is defined by planar surfaces and a thickness, T, length, L, height, H, and slots 250. As seen in FIG. 4A, each plate 224*a* includes two slots 250 including a first spacing, S1. In another embodiment seen in FIG. 4B, each plate 224*b* includes four slots 250 including a second spacing, S2, that is less than the first spacing, S1. Although the slots 250 are shown in a staggered, off-set relationship, the slots 250 may be aligned in any desirable configuration.

Regardless of the number of perimeters 18, 108*a*, 108*b*, 208 or design of the parasitic elements 24, 124*a*, 124*b*, 224, it is contemplated that an optimum design for the antenna unit 10, 100, 200 captures vertically transmitted waves. Thus, the patch antenna 12, 102, 202 may be properly tuned as a result of the increased materialization of the parasitic antenna elements 24, 124*a*, 124*b*, 224 about the dielectric substrate 14, 104, 204 to compensate for the frequency shift of the signal. As proven clearly below, the implementation of the parasitic fence 18, 108, 208 overcomes the inadequacy of conventional patch antennas 12, 102, 202 at low elevation angles. Waves radiated by the patch antenna 12, 102, 202 may be classified as space and surface waves (excluding the diffracted waves which have small effect on radiation characteristics). Space waves are the waves that propagate in air, that, for the most part, are received most of the time. Because the patch antenna 12, 102, 202 includes a dielectric constant and an air dielectric interface, a surface wave is naturally created. Thus, by locating the parasitic fence 18, 108, 208 about the substrate 14, 104, 204, the linear vertical components of surface waves are used in favor of patch antenna terrestrial reception.

Typical terrestrial performance (i.e. polarization specifications at antenna elevation angles approximately between 0° and 10°) of current patch antennas that are not adequate are improved upon by the inventive parasitic fence 18, 108, 208. For example, the minimum gain specification performance may be approximately equal to −2.0 dBi. The improvement for minimum gain specifications relating to the present invention is proved by data provided in FIGS. 5 and 6, which, respectively, show the difference in performance variations at various elevation angles of the inventive antenna unit 10, 100, 200 in view of a conventional patch antenna assembly that does not include the parasitic fence 18, 108, 208. More specifically, FIG. 5 provides data related to satellite signal reception (dBic) performance and FIG. 6 provides data related to terrestrial signal reception (dBi) performance.

Figure 5:
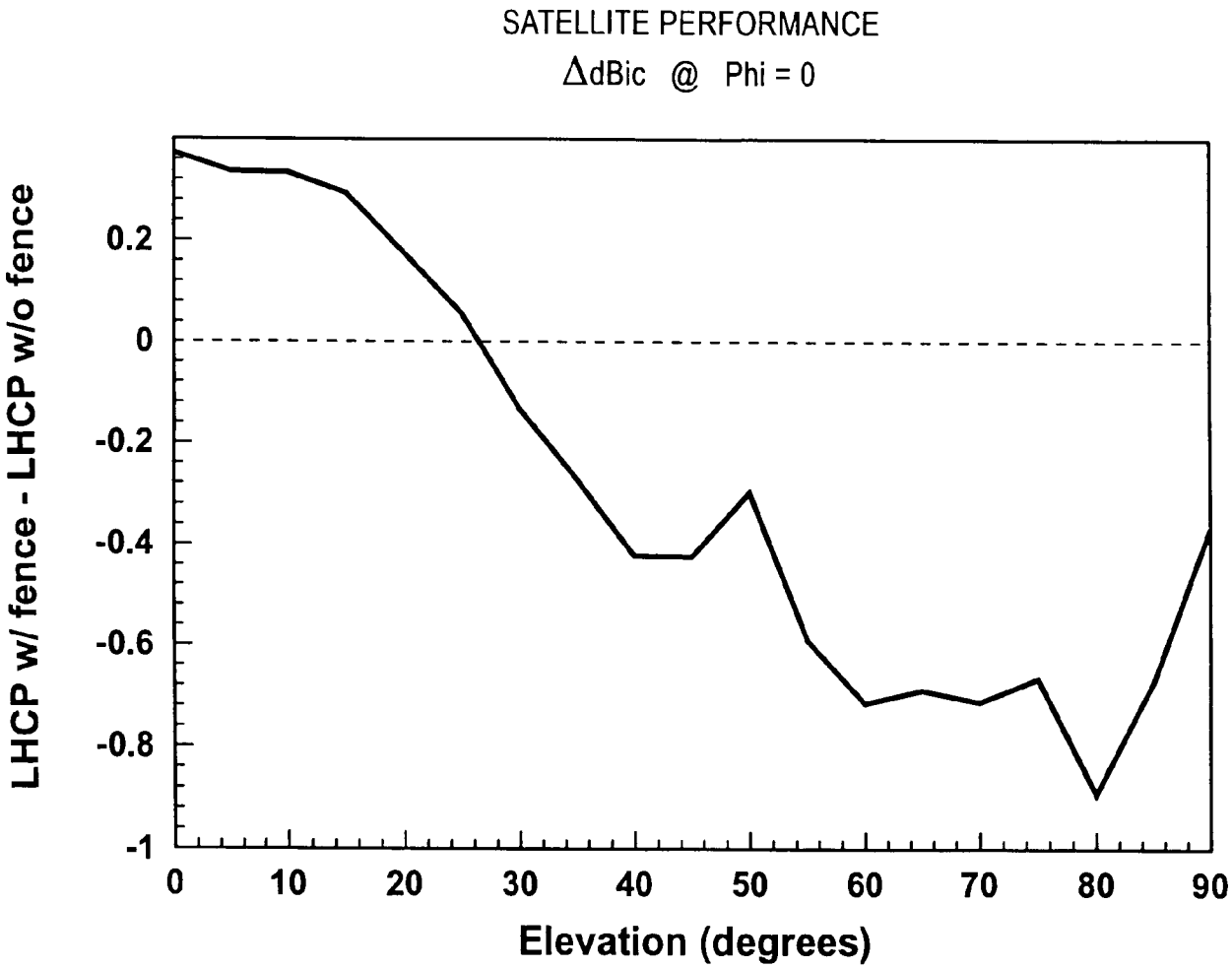
FIG. 5 illustrates the difference in satellite performance relating to the invention.
Figure 6:
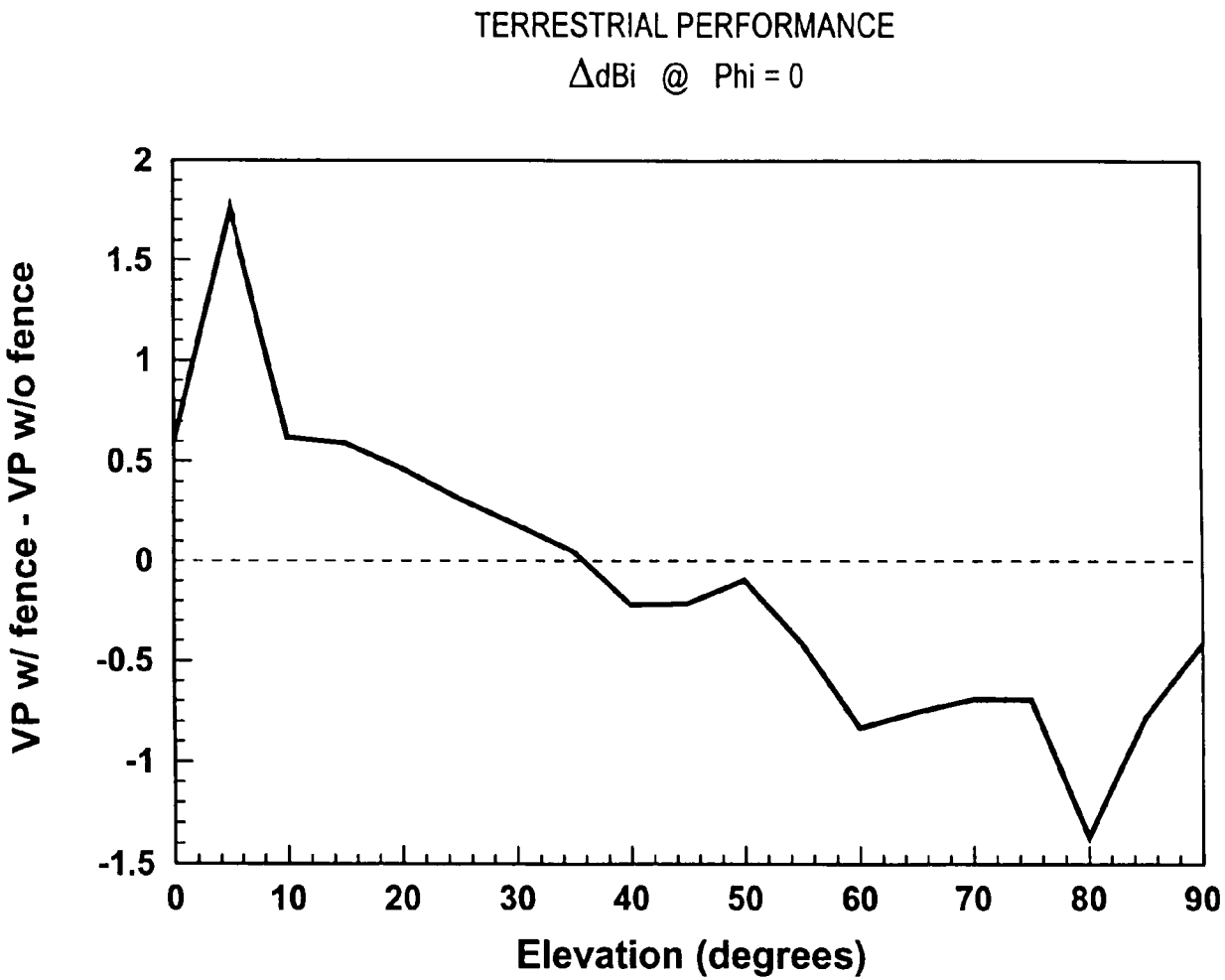
FIG. 6 illustrates the difference in terrestrial performance relating to the invention.

As illustrated in FIGS. 5 and 6, if the difference in decibels is greater than the 0 db (referenced from the dashed line) at the corresponding elevation angle, antenna performance is improved when the parasitic fence 18, 108, 208 is incorporated with the antenna unit 10, 100, 200 as opposed to providing a conventional antenna without the parasitic fence 18, 108, 208. The data on the x-axis of the chart relates to the elevation angle, θ, of the patch antenna 12 and the data on the y-axis relates to the difference in average decibels for the elevation angles from 0° to 90°.

As seen in FIG. 6, it is demonstrated that the inventive antenna unit 10, 100, 200 enhances vertical/linear polarization by 0.6 dBi at 0° and 10°, and as much as 1.80 dBi at 5°. As a result, by including the parasitic fence 18, 108, 208 an improvement in terrestrial antenna performance is seen at lower elevation angles while performance becomes somewhat degraded at higher elevation angles. However, the invention is not meant to be limited to the data as shown in FIGS. 5 and 6, and that the antenna performance may be improved upon for higher elevation angles greater by using, for example, a multi-layered dielectric substrate.

Accordingly, the parasitic fence 18, 108, 208 enhances the vertical polarization of the patch antenna 12, 102, 202 at low elevation angles by controlling the surface waves around the patch antenna, which tend to decrease the efficiency of the patch antenna 12, 102, 202 and thereby making it narrowband. As shown in the illustrated embodiment, which is not meant to limit the scope of the invention, because patch antennas 12, 102, 202 typically operates at −2 dBi, an improvement of 30% at 0.6 dBi is significant in view of the fact that the parasitic fence 18, 108, 208 does not interfere with active circuitry, and does add a significant cost in view of the cost of patch antenna units. Even further, while enhancing terrestrial performance of patch antennas, FIG. 5 demonstrates that low-elevation satellite gains may be increased as well. Thus, low quality terrestrial reception that was typically inherent to all patch antennas may be overcome at a low cost without requiring a change or causing a redesign of the active circuitry.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. For example, antenna performance may be improved by providing wire segments 24, 124 with a larger diameter or plates 224 with a greater thickness, T, to capture surface waves and reradiate linearly polarized waves more effectively. Antenna performance may also be improved by increasing the number of wire segments 24, 124 or plates 224 located on the parasitic fence 18, 108, 208 to detune the resonance frequency of the patch antenna 12, 102, 202 to a lower frequency. Even further, wire- or plate-to-patch spacing at distance, D, controls the effective dielectric constant of the substrate 14, 104, 204. The exemplary embodiments are merely illustrative and should not be considered restrictive in any way. The scope of the invention is defined by the appended claims and their equivalents, rather than by the preceding description.

What is claimed is:

1. An antenna unit, comprising:

a patch antenna element and dielectric substrate positioned on a circuit board; and a parasitically enhanced perimeter extending from the circuit board and encompassing the patch antenna that utilizes surface waves to increase linear polarization gains while maintaining circular polarization gains, wherein the parasitically enhanced perimeter defines a parasitic fence including a plurality of parasitic antenna elements soldered orthogonally to a metallic perimeter grounded to the circuit board, and wherein the metallic perimeter includes a rectangular perimeter defined by a front row opposing a back row of wire segments spaced at a first distance and a left row opposing a right row of wire segments at a second distance, and wherein the metallic perimeter is spaced from the dielectric substrate at a third distance.

2. The antenna unit according to claim 1, wherein the parasitic antenna elements and metallic perimeter are electromagnetically coupled to the patch antenna.

3. The antenna unit according to claim 1, wherein the parasitic antenna elements are straight wire segments including a diameter.

4. The antenna unit according to claim 1, wherein the parasitic antenna elements are arranged in a first inner perimeter and a second outer perimeter encompassing the first inner perimeter.

5. The antenna unit according to claim 4, wherein the parasitic elements disposed on each first and second perimeter are off-set with respect to each other.

6. The antenna unit according to claim 1, wherein characteristic linear polarization gains and circular polarization gains of said antenna unit are increased for low-elevation angles as a function of said first, second and third distances.

7. An antenna unit, comprising:

a patch antenna element and dielectric substrate positioned on a circuit board; and a parasitically enhanced perimeter extending from the circuit board and encompassing the patch antenna that utilizes surface waves to increase linear polarization gains while maintaining circular polarization gains, wherein the parasitically enhanced perimeter defines a parasitic fence including a plurality of parasitic antenna elements soldered orthogonally to a metallic perimeter grounded to the circuit board, and wherein the metallic perimeter includes a rectangular perimeter defined by a front row opposing a back row of metallic plates spaced at a first distance and a left row opposing a right row of metallic plates at a second distance, and wherein the metallic perimeter is spaced from the dielectric substrate at a third distance.

8. The antenna unit according to claim 7, wherein the metallic plates include a thickness, length and height.

9. The antenna unit according to claim 8, wherein the metallic plates include slots defined by a spacing.

10. The antenna unit according to claim 7, wherein the parasitic antenna elements and metallic perimeter are electromagnetically coupled to the patch antenna.

11. The antenna unit according to claim 7, wherein characteristic linear polarization gains and circular polarization gains of said antenna unit are increased for low-elevation angles as a function of said first, second, and third distances.

* * * * *